United States Patent [19]

Liesveld

[11] 4,176,883

[45] Dec. 4, 1979

[54] OSCILLATING LIQUID JET SYSTEM AND METHOD FOR CUTTING GRANITE AND THE LIKE

[76] Inventor: Daniel J. Liesveld, 6016 Newcombe St., Arvada, Colo. 80004

[21] Appl. No.: 800,611

[22] Filed: May 26, 1977

[51] Int. Cl.[2] ..... E21C 25/60; E21C 41/12

[52] U.S. Cl. ..... 299/17; 239/101; 239/380; 299/15

[58] Field of Search ..... 299/15, 17, 14; 239/101, 102, 4, 380; 125/1; 83/53; 175/67; 166/222

[56] References Cited

U.S. PATENT DOCUMENTS

| | | | |
|---|---|---|---|
| 2,758,653 | 8/1956 | Desbrow | 166/222 X |
| 3,756,106 | 9/1973 | Chadwick | 83/177 |
| 3,857,516 | 12/1974 | Taylor et al. | 299/17 |
| 3,960,407 | 6/1976 | Noren | 299/17 |

FOREIGN PATENT DOCUMENTS

| | | | |
|---|---|---|---|
| 207854 | 6/1968 | U.S.S.R. | 299/17 |

*Primary Examiner*—William Pate, III

[57] ABSTRACT

A method and apparatus for cutting rock materials has been devised in which a series of jets are produced by a nozzle assembly, the nozzle assembly being constructed and arranged to advance along the surface of the rock material and to form a channel or line of cut of predetermined width and depth therein. As the nozzle assembly makes each pass along the intended line of cut, the assembly is oscillated in a direction transversely of its path of travel along the intended line of cut in order to better erode the material, form a clearly defined channel with a minimum of interference which may otherwise result from spalling or collection of liquid in the channel. Alternate forms of systems are disclosed which are capable of cutting at different selected angles ranging between vertical and horizontal lines of cut; and alternating forms of oscillating means are disclosed which may consist either of utilization of a revolving cam within a channel formed in the nozzle assembly or high intensity pulse jets which alternately deliver pulses of water under high intensity against opposite sides of the nozzle assembly.

26 Claims, 11 Drawing Figures

OSCILLATING LIQUID JET SYSTEM AND METHOD FOR CUTTING GRANITE AND THE LIKE

BACKGROUND OF THE INVENTION

This invention relates to a novel and improved high intensity oscillating jet adaptable for cutting hard rock materials such as granite and the like in a rapid and dependable manner.

Various systems have been devised for cutting hard rock materials employing a high intensity jet which will deliver liquid at a sufficiently high pressure and concentration against the surface to form a well defined slit. Typical of this is the method and apparatus set forth in my copending application for patent entitled METHOD & APPARATUS FOR CHANNEL CUTTING OF HARD MATERIALS USING HIGH VELOCITY FLUID JETS, Ser. No. 610, 577, filed 5 Sept. 1975. In that system, a nozzle assembly includes a series of nozzles arranged to form a divergent jet pattern with suspension means for the nozzle assembly which will permit its reciprocation in a direction toward and away from the line to be cut. This system has been found to be particularly effective in forming straight-walled channels or slits for a substantial distance into the material without spalling or substantial jet impedance. Other typical approaches taken to cutting of hard rock materials employing high intensity jets are disclosed in the U.S. Pat. No. 3,883,075, to Edney Noren U.S. Pat. No. 3,960,407 and Sweetman U.S. Pat. No. 2,587,243.

It is desirable to provide a jet cutting system which will afford the deepest possible penetration in forming a well defined slit through the material while permitting the cutting operation to proceed at a relatively high rate of speed. Additionally, it is important that the jets be angled into the groove or slot in such a way as to erode a clear and open bottom for the escape of water and eroded material so as not to impede the direct flow of water against the bottom of the grooves. Moreover, in cutting relatively deep channels, it is desirable to so form the channel as to maintain relatively straight walls and to prevent the channel from narrowing while at the same time concentrating the jet stream across a uniform width.

SUMMARY OF THE INVENTION

It is therefore an object of the present invention to provide for a novel and improved method and apparatus for cutting relatively hard rock materials such as granite and the like.

It is another object of the present invention to provide a method and means for oscillating a jet stream for impingement at a high intensity along a line or slot to be cut in the material and in such a way as to achieve relatively deep penetration while maintaining a uniform width of the slot or groove throughout.

It is a further object of the present invention to provide for a high intensity jet cutting system in which means are provided for oscillating the jet at relatively high frequencies in a duration transversely of the path of travel of the jet in forming a line or slot in a hard rock material to be cut.

An additional object of the present invention is to provide for a novel and improved series of high intensity water jets and means for oscillating same which will assure uniform penetration and cutting of rock materials in rapid and efficient manner, and further wherein the jets are capable of traversing either vertical or horizontal lines of cutting in forming well defined channels.

In accordance with the present invention a system and method has been devised for cutting hard rock materials utilizing one or more jets. For instance, laboratory testing indicates that a single jet of high pressure fluid on the order of 45,000 lbs. per square inch is capable of cutting a slot in granite on the order of 3/16th of an inch deep by one inch long over a time interval of one second. The same jet is capable of cutting a slot ¼th of an inch deep by one inch long but with a greatly increased width of slot if the jet is oscillated sideways or transversely of its forward direction of movement along the line to be cut. Accordingly, oscillation at predetermined frequencies is capable of achieving deeper penetration and a wider, but accurately defined, slot or groove when the jet or series of jets is oscillated. Cutting progresses at a much faster rate since the jet is not impeded by cavitation or eroded material within the confines of the slot. Thus for instance the channel formed may be substantially wider and deeper when oscillation is employed even with a single jet since the jet is continually angling and cutting a wider groove. Again however the process has been found to be effective in eroding a clear and open channel for the escape of water and eroded material with a minimum of impedance of the high intensity jet stream.

In cutting deep channels in granite or other hard rock materials, it is necessary to have the channel wide enough for entrance of the nozzle producing the jet and allow for its movement through channel. The desired channel width may be obtained by selecting one or more nozzles and preferably in a somewhat divergent pattern so that when oscillated, an accurately defined relatively straight wall with bottom corners is formed. Another desirable feature of the present invention is to utilize somewhat higher intensity or stronger outside jets than the inner jets to achieve optimum penetration and cutting in the bottom corners of the channel. This assures a straight wall and prevents the channel from narrowing as cutting progresses through the channel.

The speed of traversal and oscillation may vary with the hardness and composition of the material being cut. Most desirably variable speed motors can control both functions. For instance, a medium hard granite may be cut with a traverse speed on the order of two inches per second and an oscillation rate of 750 cycles per minute, the channel cutting rate being approximately 30 square feet per hour. The cutting rate on limestone or other softer materials could allow for even greater rates of traversal as well as oscillation.

One embodiment of the present invention employs a nozzle suspension system including a revolving cam which imparts transverse oscillatory motion to a series of nozzles as the nozzles are advanced along the line to be cut. In another form of the present invention, the nozzle assembly is suspended by a lance or elongated support which is adapted to advance back and forth in a vertical direction perpendicular to the surface of the material, and oscillatory motion in a direction transversely of the path of travel is imparted by a separate liquid delivery system which imparts alternate pulses to the lance causing an oscillatory motion in a direction transversely of the path of travel to be established. In the modified form, most desirably the lance is supported by a shell or other guide member which assures straight entry and exit of the lance in the channels with the jets cutting on the entry and exit trips of the lance as it is caused to reciprocate up and down. Thus the procedure for quarry channeling is to erode the granite on the entry trip, followed by forward advancement of the guide for a limited distance of ¼th inch and thereafter the traveling jets erode another section of granite on the exit trip. The procedure is repeated as the car moves forward for the re-entry and exit until a relatively deep channel is eroded to the desired depth and length. Horizontal channeling may be achieved by mounting the lance and guide horizontally on the car or other advancing unit.

BRIEF DESCRIPTION OF THE DRAWINGS

The foregoing and other objects, features and advantages of the present invention will be more readily understood in conjunction with the following description of an exemplary preferred embodiment.

DETAILED DESCRIPTION OF THE PREFERRED EMBODIMENT

Figures 1, 2:
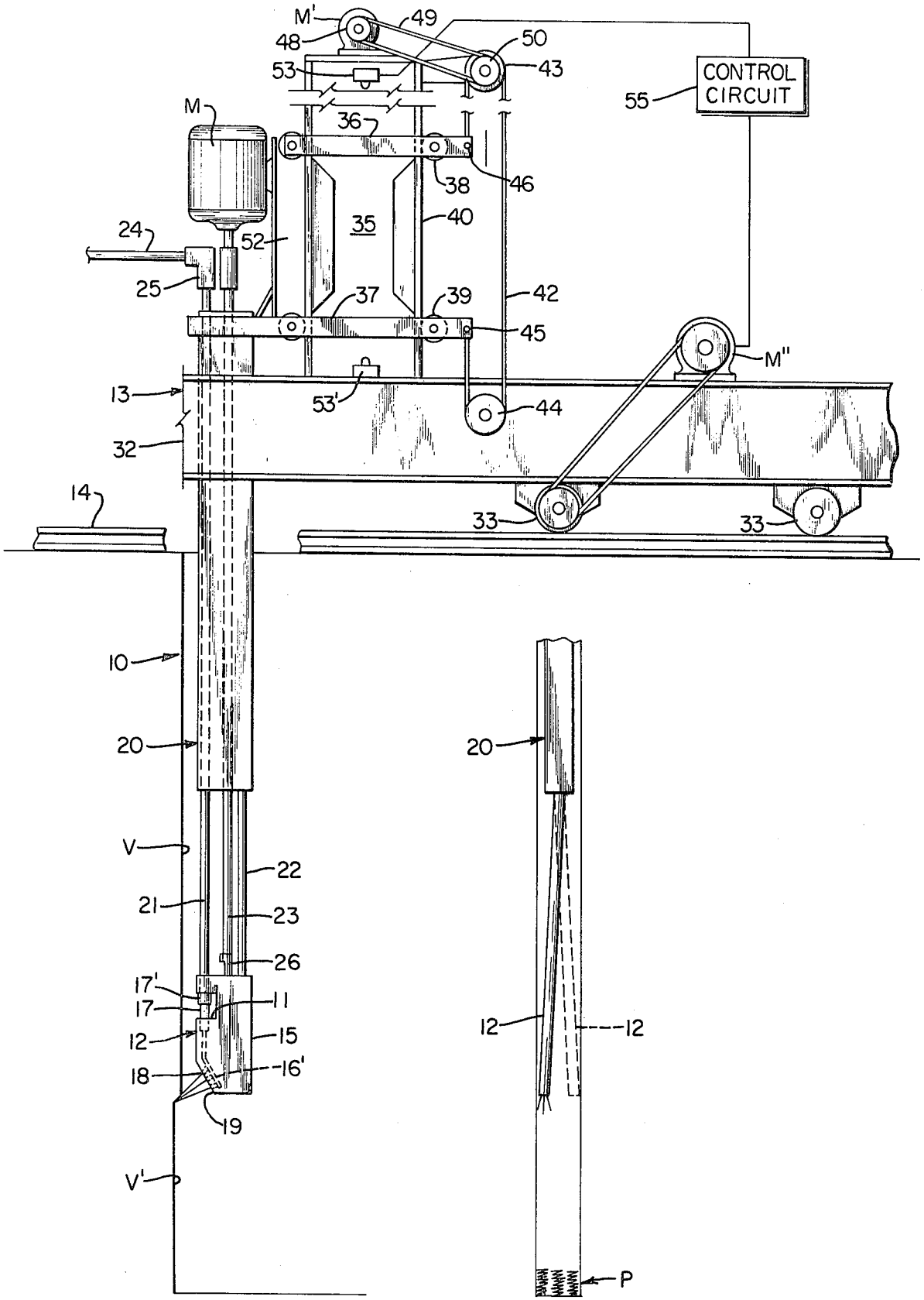
FIG. 1 is a somewhat schematic side view of a preferred form of oscillating fluid jet system in accordance with the present invention.
FIG. 2 is a somewhat schematic end view of the lower portion of the suspension means and nozzle assembly as shown in FIG. 1 and illustrating the cutting pattern of the jets.

Referring in detail to the drawings, a preferred form of oscillating fluid jet cutting apparatus 10 is illustrated in FIGS. 1 and 2, the apparatus being broadly characterized by its ability to oscillate a nozzle assembly 12 as it is advanced simultaneously in a generally vertical or up and down direction, the oscillation and advancement of the nozzle assembly being further coordinated with horizontal advancement or travel of the upper frame assembly 13 along a guide track represented at 14. In the preferred form, the nozzle assembly 12 is comprised of a nozzle block 15 containing a manifold 16 communicating with a supply tube 17 which supplies water under pressure to a series of nozzles or jets 18 which incline downwardly from the manifold 16 and exit through an inclined surface 19 of the nozzle block or holder 15. The nozzle block is rectangular in cross-section with the inclined surface 19 forming a relieved portion along one vertical side of the block, and a recessed portion 11 is formed directly above the inclined surface to facilitate mounting of the lower end of the supply tube 17 in the nozzle block by a union 17' which is threadedly secured to the tube in the recessed portion directly above its connection into the manifold. Although forming no part of the present invention as such, the nozzles or jets 18 may be of the type disclosed in more detail in my hereinbefore referred to copending application for patent Ser. No. 610,577 in which a series of three sapphire nozzles are provided with generally conical bores leading into orifices whereby to concentrate and to discharge the fluid through the orifices in the form of extremely high velocity concentrated streams.

Figure 3:
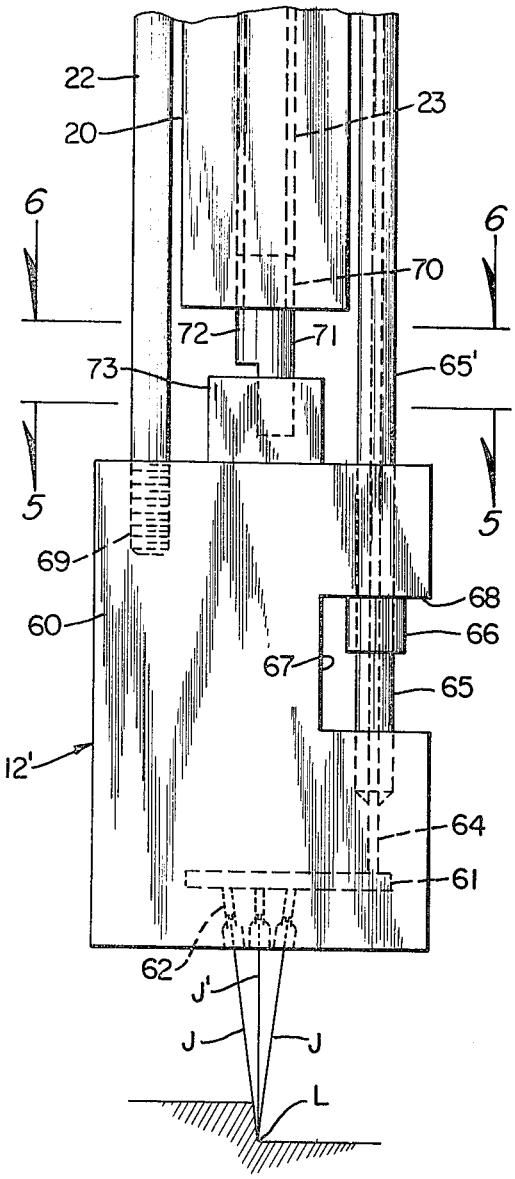
FIG. 3 is an enlarged, fragmentary view showing in more detail the lower end of a modified form of nozzle assembly adaptable for use with the suspension means of FIGS. 1 and 2.

The nozzle assembly 12 is suspended by a main sleeve guide 20 which is elongated and of generally rectangular cross-section through which are extended outer, elongated cylindrical supports 21 and 22 and an intermediate cam drive shaft 23 in parallel to one another. The outer support 21 takes the form of an elongated tube or pipe which extends from connection to the lower supply tube 17 by the union 17' in the nozzle assembly upwardly through and connected to the sleeve guide 20 for connection into a high pressure water source, not shown, but which is connected to flexible hose 24 and an elbow-shaped fitting 25 into the tubular support 21. The support 22 preferably takes the form of a solid elongated rod of limited flexibility which is rigidly affixed at its lower end to the nozzle block 15 and extends upwardly to terminate in an upper end above the sleeve guide 20 so as to serve along with the tube 21 as the main means of suspension of the nozzle assembly from the sleeve guide. The cam drive employed in the preferred form of FIGS. 1 and 2 is hereinafter described in more detail with reference to FIGS. 3 and 4 but broadly takes the form of a drive shaft 23 which is journaled for rotation within the sleeve guide 20 and is driven by a variable speed drive motor M coupled to the upper end of the drive shaft 23. In turn the lower end of the drive shaft terminates in a cam 26 which rides in a channel formed in the upper surface of the nozzle block 15 and imparts side-by-side or transverse oscillation to the block; or in other words when viewed from the front as in FIG. 2 will cause the nozzle assembly to be oscillated in a lateral direction in the manner illustrated so as to cause the fluid jets to describe a zig-zag cutting pattern as generally designated at P in FIG. 2.

The sleeve guide 20 is slidable through a main horizontal frame or chassis 32, the latter provided with track engaging wheels 33 for advancement of the entire assembly along the guide track 14. A main vertical support is defined by a standard 35 in the form of a vertical I-beam adapted for mounting of upper and lower spaced horizontal frame members 36 and 37 which carry roller pairs 38 and 39, respectively, for slidable movement along horizontally spaced, vertical tracks 40 which are mounted on the vertical support 35. Rolling movement of the roller pairs 38 and 39 is controlled by a suitable chain or belt drive and here defined by a chain 42 trained over upper and lower sprockets 43 and 44 with one end 45 of the chain affixed to the lower frame or bar 37 and the other end 46 affixed to the upper frame 36. Vertical motion is imparted to the chain drive by a reversible drive motor M' which has its drive shaft drivingly connected to a pulley 48 over which is trained a power transmission belt 49 leading into a driven pulley 50, the latter keyed for rotation on the axle for sprocket 44 so that continuous rotation of the pulley 50 will cause the sprocket 43 to drive the chain 42 in advancing the upper and lower frame members 36 and 37 along the vertical tracks 40.

The sleeve guide 20 is slidable independently of the main frame 35 but has its upper end affixed to the lower frame 37 so as to follow movement of the frame members 36 and 37 and impart corresponding vertical motion to the nozzle assembly. In addition, the motor M is affixed to a vertical motor mount 52 and together with the supply line 24 and tubing 21 will follow the vertical reciprocation of the sleeve guide. Preferably the track-engaging wheels are driven off a separate motor drive M″ so that the rate of advancement of the guide assembly is closely coordinated with the rate of reciprocation of the sleeve guide while permitting the nozzle assembly to be oscillated independently under the control of the motor drive M. For the purpose of illustration, the motor drive M may consist of a one-half horsepower variable speed DC motor which is capable of oscillating the nozzle assembly at the rate of 750 cycles per minute; and for a suspension system consisting of the sleeve guide 20 and supports 20–22 being of an overall length on the order of 10 to 12 feet will cause displacement of the nozzle assembly approximately ½ inch in either direction. The angularly disposed nozzles or jets in turn will be capable of describing a generally serrated or zig-zag pattern as the assembly is simultaneously advancing along a vertical line of cut, again as illustrated at P in FIG. 2. In order to initiate a cutting operation, a hole is drilled to the desired depth, for instance, by a jack hammer, the hole being of a diameter to permit full insertion of the nozzle assembly to the bottom of the hole and with sufficient clearance for lateral oscillation. Drive motor M′ is activated along with the oscillating motor M so that the nozzle assembly is oscillated as it is drawn upwardly through the hole to initiate cutting into the vertical wall represented at V. The depth or extent of cutting represented at V′ is achieved by the delivery of water under pressure through the supply tube 17 into the nozzles 18 and in a pattern hereinafter described in more detail with reference to FIGS. 8 to 8B. At its upper end of travel at the top of the hole, upper frame 36 will depress a limit switch 53 causing motor M′ to be de-energized and motor M″ to be energized through a control circuit represented at 55. Preferably, the control circuit is designed to energize the motor M″ for a time interval to advance the apparatus horizontally along the track a limited distance and in a direction corresponding to the depth of the cut. The motor M″ is then de-energized and a reversing signal applied to the motor M′ to drive the sleeve guide 20 downwardly through the hole in performing the next cut. Upon reaching the lower end of travel a limit switch 53′ is engaged by lower frame 37 to de-energize the motor M′ and energize the motor M″ whereupon the entire sequence as described is repeated. Oscillation of the nozzle assembly 12 in a manner to be hereinafter described and shown in more detail in FIGS. 3 to 7 is operative not only to widen the channel but to finely pulverize the rock material so as to minimize spalling and impedance with the high pressure jets, in addition to other advantages referred to hereinafter. The rate of vertical advancement may be on the order of 10 feet per minute then is advanced horizontally a distance corresponding to the depth of cut ¼ inch at the end of each vertical stroke.

Figure 7A:
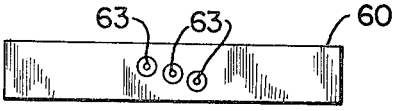
FIG. 7A is an end view of the nozzle assembly showing the arrangement of the nozzles in the nozzle block.
Figure 6:
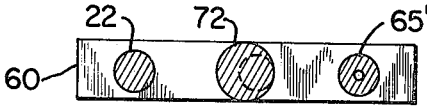
FIG. 6 is a cross-sectional view taken about lines 6—6 of FIG. 3.
Figure 7:
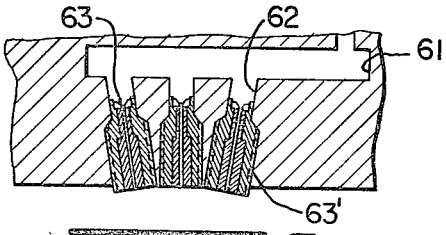
FIG. 7 is a sectional view illustrating the nozzle arrangement shown in FIG. 3.

An alternate form of nozzle assembly 12′ is illustrated in FIGS. 3 to 7 similar to that shown in the preferred embodiment wherein like parts with respect to those parts shown in FIGS. 1 and 2 are correspondingly enumerated, the nozzle assembly 12′ being adapted specifically for the purpose of carrying out the horizontal cutting operations. The alternate form is seen to consist of a generally rectangular nozzle block 60 which is provided with a substantially horizontally extending manifold 61 formed internally of the block 60, and a series of exit ports or bores 62 extend downwardly from the manifold and are provided with enlarged counterbores at their lower ends for insertion of sapphire nozzles 63 supported in sleeves 63′ threaded into the bores 62, as shown in FIG. 7. Preferably, the nozzles 63 are inserted at the upper ends of the sleeves 63′ to define a conical orifice of a limited diameter on the order of 0.010 inches where for example the water is supplied at a pressure of 45,000 psi. A vertical bore or groove 64 serves as a supply conduit into the manifold 61 from an enlarged supply pipe or tube 65. Again tube 65 is secured by a retainer nut or union 66 in a recessed portion 67 of the block directly beneath an overhang 68 of the block, the tube extending upwardly into a pipe 65′ which passes through the overhanging portion 68 for extension into the lower end of a sleeve guide, not shown, which corresponds to the sleeve guide 20 of FIGS. 1 and 2.

Figure 5:
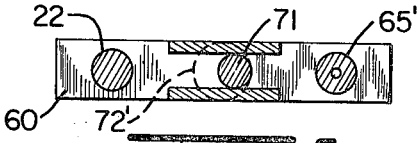
FIG. 5 is a cross-sectional view taken about lines 5—5 of FIG. 3.

A support rod 22 is provided with a lower threaded end 69 which is threadedly connected into a threaded bore in the upper end of the block in horizontally spaced relation to the supply tube 65′. In addition, a drive shaft 23 is journaled in a bearing 70 and terminates in a cam 72 which has an offset or eccentric 71 movable in an open channel formed between laterally spaced upwardly projecting plates 73. As shown in FIGS. 5 and 6, the eccentric reduced portion 71 is sized to be of a diameter corresponding to the spacing between the inner confronting surfaces of the plate 73 and is disposed in off-center relation to the enlarged end of the cam 72 whereby rotation of the drive shaft will impart lateral oscillation to the nozzle block 60 by causing the eccentric 71 to follow the path of rotation as illustrated at 72′. Although not shown, a suitable bearing may be formed on the eccentric 71 in order to minimize frictional engagement between the eccentric and the plates 73.

Figure 4:
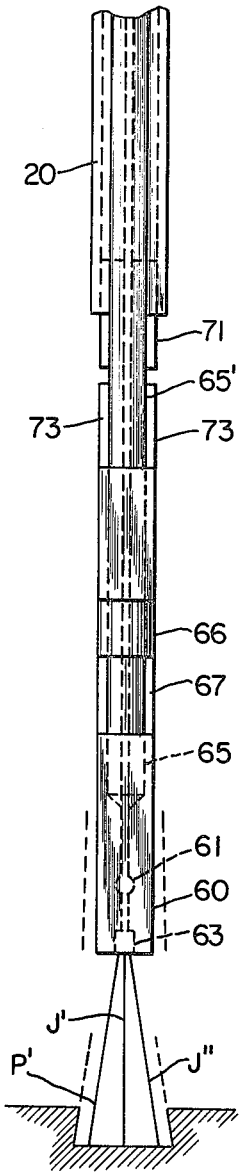
FIG. 4 is a front view of the nozzle assembly as shown in FIG. 3.

The lateral oscillation which is imparted by th eccentric is communicated to the nozzle block 60 whereby to cause the nozzles to describe a cutting pattern as represented at P′ in FIG. 4. Preferably, the nozzles are arranged so as to be angled in downwardly convergent relation to one another when viewed from the side, as in FIG. 3, to direct the individual jets represented at J along a common line; however, as viewed in FIG. 4 as well as FIG. 7, the jets or nozzles 63 are arranged along a diagonal line with the center jet striking the midpoint of the channel as represented at J′ and the outer jets striking the outside corners of the channel as represented at J″ so that when viewed from the front, or on a line parallel to the path of travel, the jet pattern is outwardly divergent across the width of the channel while cutting along a single line L in a direction normal to the length of the channel. Lateral oscillation will cause the jet streams to overlap one another as illustrated in FIG. 7A as cutting progresses in a horizontal direction by advancement of the main frame along the guide track, as described with respect to FIGS. 1 and 2. At the end of each cut or line of cut, the apparatus is reversed and the nozzle block lowered preferably a distance corresponding to the depth of cut in preparation for the next path along the channel to be formed as described in my hereinbefore referred to application for patent Ser. No. 610,577. Cutting may progress vertically for a distance limited by the length of the suspension means for the nozzle block and the vertical drive.

Modified Form of the Preferred Embodiment

Figures 8, 8A, 8B:
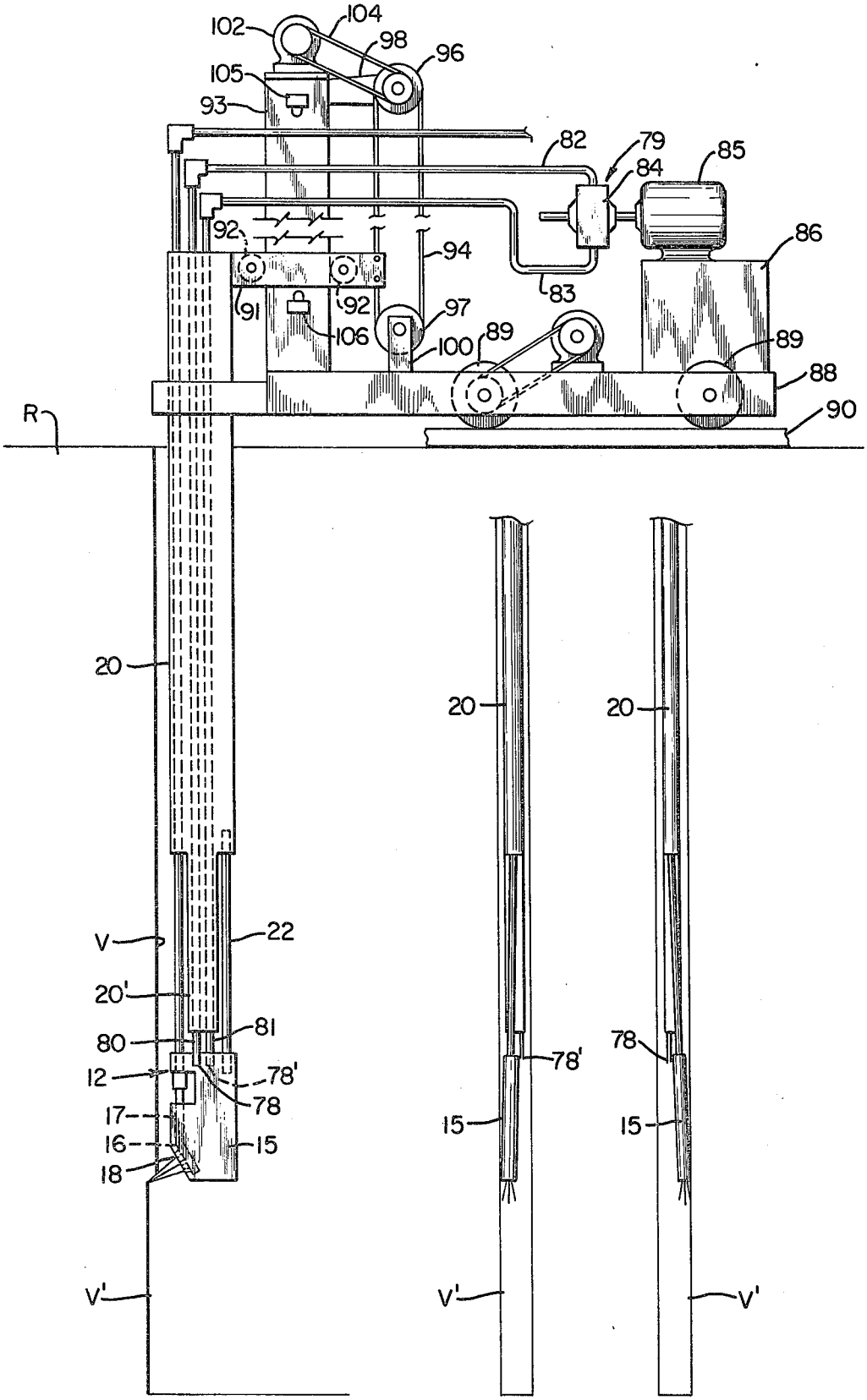
FIG. 8 is a somewhat schematic side view of another modified form of oscillating fluid jet cutting system in accordance with the present invention.
FIGS. 8A and 8B are somewhat fragmentary front views of the lower suspension systems and nozzle assembly of the modified form of FIG. 8 and illustrating the path of oscillation of the nozzle assembly.

A modified form of the present invention is illustrated in FIGS. 8, 8A and 8B in which a jet fluid cutting system is oscillated by alternating water jet pulses applied to the nozzle assembly through a separate water circulating system. Again, like elements to that form of invention shown in FIGS. 1 and 2 are correspondingly enumerated. In the modified form, nozzle assembly 12 includes a nozzle block 15, a manifold 16 which receives water under pressure through supply tube 17 for delivery into a series of nozzles 18 which are arranged to form the same jet impingement pattern as described with reference to FIGS. 1 and 2. In addition, a sleeve guide 20 permits vertical extension of the water supply tube 17 and also includes a support rod 22 which together with the support tube 17 serves to suspend the nozzle assembly 12 in spaced relation below the sleeve guide.

Oscillation of the nozzle assembly is achieved in the modified form by alternating pulses of water under high pressure which are delivered to high pressure pipes 80 and 81, each pipe terminating at its lower end in a downwardly inclined, inwardly directed orifice 78 which is aligned to direct the water under high intensity into the upper side surface of the nozzle block 15. As best seen from FIGS. 8A and 8B, the orifices 78 and 78' are arranged for disposition on opposite sides of the nozzle assembly and are coordinated with a high intensity water source generally designated at 79 to alternately, or sequentially, deliver pulses of water against the side of the nozzle block at a frequency of rate such as to cause the nozzle block to oscillate in a direction transversely of the advancement of the entire assembly. The high pressure delivery conduits or pipes 80 and 81 extend intermediately of the water tube 17 and rod 22 through a lower extension 20' of the sleeve guide 20 from delivery hoses 82 and 83 leading from a piston pump 84 which is coupled to a motor drive 85, the pump 84 communicating with a suitable reservoir or supply source for the water as designated at 86. The pump 84 and motor drive 85 may assume other forms but broadly are designed to alternately deliver water to each hose 82 and 83 under sufficiently high pressure to be directed by the orifice 78 or 78' at an extremely high intensity and velocity against the side of the nozzle assembly.

The system 79 is mounted on a main frame 88 which is provided with track-engaging wheels 89 adapted for advancement along a generally V-shaped guide track 90. A reciprocating frame 91 is adapted to suspend the sleeve guide along with the delivery conduits into the nozzle assembly and the nozzle assembly itself for vertical movement, the frame having rollers 92 which are arranged for rolling movement along opposite vertical sides of a vertical support frame or post 93, and the end of the frame 91 opposite to that supporting the sleeve guide is affixed to a chain drive which is defined by a chain 94 trained over upper and lower sprockets 96 and 97, respectively. The upper sprocket 96 is rotatably mounted on a support bracket 98 extending horizontally from the upper end of the post 93 and the lower sprocket is rotatably mounted on a bracket 100 projecting upwardly from the main frame 88. A variable speed drive motor 102 is drivingly connected to the chain drive through a suitable power transmission drive illustrated at 104 into the upper sprocket 96 so as to impart vertical movement to the nozzle assembly 12 along the desired line of cut. An upper limit switch 105 and a lower limit switch 106 are positioned on the vertical support 93 to define the upper and lower limit of the movement of the nozzle assembly, each of the limit switches being electrically connected to a suitable control circuit, not shown, into the horizontal drive motor 86 so that at the end of each vertical pass of the nozzle assembly, the vertical drive motor 102 will be de-energized and the horizontal drive motor 86 energized to advance the frame a limited horizontal distance for the next pass or line of cut in the same manner as described with reference to FIGS. 1 and 2.

Initially a jack hammer hole is drilled into the quarry floor to a depth corresponding to the desired depth of the line or cut, the hole size being of a diameter to accommodate the nozzle assembly and sleeve guide with sufficient clearance for oscillation. In carrying out a typical cutting operation with the modified form of apparatus shown in FIGS. 8 and 8B, the tracks will be positioned to traverse the desired channel to be formed in the granite or other rock material with the nozzle assembly initially positioned in confronting relation to the vertical wall represented at V of the rock material designated R. Initially, the nozzle assembly may be set either at the bottom or top of the vertical line to be cut and the chain drive motor 102 initially activated by vertical movement of the nozzle assembly along the desired line of cut. As the nozzle assembly 12 is advanced along the vertical sidewall V, horizontal oscillation is simultaneously imparted to the nozzle assembly by energization of the oscillating drive motor 85 to cause alternating pulses to be discharged from the orifices 78 and 78'. By employing a motor drive and piston pump of the type described, pulses may be alternately delivered to opposite sides of the nozzle assembly to establish horizontal oscillation of the nozzle assembly which for example may be displaced on the order of 3/16 of an inch. As the nozzle assembly is oscillated, it is continuously advanced in a vertical direction until the sleeve guide 91 strikes the upper limit switch 105 to deactivate the drive motor 102 and activate the horizontal drive motor 86 to advance the entire apparatus along the track for an incremental distance in preparation for the next cut in the opposite direction. For the purpose of illustration, the incremental distance of movement may be on the order of ¼ inch, at the end of which the control circuit will deenergize the horizontal drive motor 86 and reverse the vertical drive motor 102 to cause downward vertical movement of the nozzle assembly until the frame 91 reaches its lower limit of movement striking the lower limit switch 106 and once again de-energizing the vertical drive motor 102 and energizing the horizontal drive motor 86. Thus for each vertical pass or line of cut of the nozzle assembly approximately ¼ inch of rock granite is eroded; and with the nozzle vibrating side to side at the rate of 750 cycles per minute will form a channel ¾ inch wide along the vertical line of cut. By virtue of the divergent impingement pattern of the jets, the width of the channel will be greater than the width of the sleeve guide or nozzle assembly so as to assure more than enough clearance for horizontal oscillation and advancement of the nozzle assembly along the channel formed.

It has been established through laboratory testing that even a single jet of high pressure fluid on the order of 45,000 psi is capable of cutting a slit in granite on the order of 3/16 inch deep and 1 inch long in one second, the slit being 0.010 inch wide. However, the same jet is capable of forming a groove ¼ inch deep by 1 inch long in one second, and the groove will be 3/16 inch wide if the jet is oscillated sideways to move forward. Accordingly, substantially deeper penetration is obtained over a wider area if the jet is oscillated since the jet is not impeded by cavitation or bounce-back of water and material cuttings in the confines of the slit. In other words the channel is eighteen times wider and 1/16 inch deeper when even limited oscillation is employed since the oscillating jet is continually angling and cutting into the step formed in the sidewall for instance as represented at S in FIG. 8. This technique erodes a clear and open bottom for the escape of water and eroded material with little or no jet impedance.

In cutting a channel in granite eight feet deep it is necessary to have the channel wide enough for the nozzles to follow movement along the channel, thus such channel width may be obtained with a series of jets, there being a series of three jets as illustrated in FIGS. 8 to 8B which are caused to form the divergent impingement pattern as illustrated. Preferably the nozzle is ⅜ inch wide and the oscillation stroke is 3/16 inch or a total of 9/16 inch in operation. The divergent or flared jets coupled with the oscillatory movement would therefore erode a channel ¾ inch wide. The outside jets may be 0.011 inch orifice size. the inside jet an 0.009 orifice diameter. The stronger outside jets are needed for good penetration and cutting in the corners thereby assuring a straight wall in the channel and preventing the channel from narrowing. The traverse speed and oscillation speed will vary with the hardness and composition of the stone and for this reason it is preferable that variable speed motors be employed to control both functions.

A medium hard granite may be cut with a traverse speed of 2 inches per second and an oscillation rate of 750 cycles per minute. The channel cutting rate is approximately 30 square feet an hour or three times faster than any present method employed. The cutting rate in limestone or other softer materials is two to three times faster which would permit much faster traverse speed and oscillation rate.

In the quarry jet machine illustrated in FIGS. 8 to 8B, the nozzle is suspended for movement along a line of cut on the order of 8 feet. Thus the lance is lowered through the 8 foot distance following which the entire apparatus is advanced along the track for a limited distance on the order of ¼ inch. The nozzle is reversed to advance along the desired line of cut in the opposite direction as earlier described following which the apparatus is horizontally advanced another limited increment until the entire channel is completed.

Utilization of oscillating jets in the manner described has proven to pulverize the granite into a fine sand which will not tend to block or interfere with the nozzle movement, and further, oscillation by means of water jet pulses will increase the efficiency not only by its cooling action but in flushing out the fines as well. In the absence of oscillation, slitting and spalling can be expected to occur, the resultant chips being large enough to impede or interfere with the movement of the nozzle along the channel. As stated earlier, which the pattern of the jets diverges or flares in the lateral direction they also converge in the direction of the line of cut so as to form a straight line perpendicular to the channel. Accordingly, this straight line of impingement concentrates all the forces of the jets into a narrow band that results in the cutting, fracturing, granulating and eros ion of the crystals. Wider channels may be formed by increasing the stand-off distance between the nozzle and the material. Thus, while the normal distance from the nozzle to the surface may be on the order of 1 inch which will erode a channel 11/16 inch wide, a 2 inch spacing would permit erosion of a channel on the order of 1 inch wide. It has been found that the nozzle unit as described can be very effective for distances up to 2½ inches from the cutting surface. Moreover, while the apparatus has been shown and described with respect to vertical channeling it is readily conformable for use in horizontal channeling or in other angles by modifying the frame to permit its adjustment to different attitudes. Of course in horizontal channeling most desirably the horizontal drive motor would be employed in advancing the nozzle assembly along the desired line of cut and the vertical drive employed for incrementally advancing the nozzle assembly in preparation for the next path or line of cut.

From the foregoing, it will be recognized that the apparatus of the present invention permits formation of a channel that is smooth with straight sides and is sufficiently wide for the nozzle to operate in the channel and erode to a predetermined depth and of any desired length. In the preferred and modified forms disclosed in FIGS. 1, 2 and 8 to 8B the fan pattern is such as to assure the necessary width of channel and nozzle clearance in a direction transversely of the length of the channel; and by aligning the jets in a straight line along a direction perpendicular to the channel they are capable of concentrating and slotting in a relatively straight line across the channel to afford vastly improved cutting and pulverizing of the rock and minimizing spalling.

Although the present invention has been described with a certain degree of particularly, it is understood that the present disclosure has been made by way of example and that changes in details and structure may be made without departing from the spirit and scope as defined by the appended claims.

What is claimed is:

1. The method of cutting hard rock material comprising the steps of:
   (a) directing at least one high intensity jet against the surface of the material to be cut;
   (b) advancing each said jet along a perdetermined path of travel coinciding with the line to be cut along the surface of the material; and
   (c) oscillating the jet along the surface to be cut in a direction transversely of the direction of advancement of said jet along the line to be cut and transversely to the direction of impingement of said jet, said oscillation of the jet being at a rate of speed greater than the rate of speed of travel of said jet along the line to be cut.

2. The method according to claim 1 in which a series of jets are arranged in a divergent pattern along the line to be cut and said jets are oscillated at a frequency approximately 750 cycles per minute.

3. The method according to claim 1 in which the width of oscillation of the jet is approximately one-half the width of the jet pattern.

4. The method according to claim 1 in which a series of jets are arranged in a divergent pattern transversely of the travel along the line to be cut with jets located on the outside being of a greater pressure than those jets on the inside of the pattern formed.

5. The method according to claim 1 in which the rate of travel and rate of oscillation are varied with the hardness of material being cut each said jet being advanced along the line to be cut then advanced in a direction normal to the line of cut to increase the depth of penetration of the jets.

6. The method according to claim 5, the rate of oscillation of each said jet being on the order of 750 cycles per minute.

7. The method of cutting granite and the like comprising the steps of:

(a) directing a series of high intensity liquid jets from a plurality of nozzles against the surface of the material to be cut;

(b) advancing said jets along a predetermined path of travel coinciding with the line to be cut; and (c) oscillating the jets at a high frequency approximately 750 cycles per minute in a direction transversely of the direction of advancement of said jets along the line to be cut and generally transversely of the direction of said jets from said nozzles to the surface of the material to be cut.

8. The method according to claim 7 in which a series of jets are arranged to form a divergent pattern in a plane perpendicular to the line to be cut.

9. The method according to claim 8 in which the width of oscillation of said jets is on the order of one-half times the width of the jet pattern with stronger jets located on the outside than on the inside of the pattern formed.

10. Apparatus for forming a channel in relatively hard rock materials comprising:

a nozzle assembly including means for supplying liquid under pressure to form a high intensity jet discharged from said nozzle;

means for advancing said nozzle assembly at a predetermined rate of speed along the surface of the material to be cut; and oscillating means for oscillating said nozzle in a direction transversely of its direction of travel along the surface of the material at a rate greater than said predetermined rate of speed.

11. Apparatus according to claim 10 in which said oscillating means is operative to oscillate said nozzle at a frequency in the range of 750 cycles per minute.

12. Apparatus according to claim 10 wherein said nozzle assembly includes a series of nozzles arranged to produce a divergent jet pattern and said oscillating means being operative to oscillate said nozzle assembly over a distance approximating one-half the width of the jet pattern formed by said nozzle assembly.

13. Apparatus according to claim 10 in which liquid supply means includes means for suspension of said nozzle assembly a predetermined height above the surface to be cut, and said oscillating means includes a cam member rotatable in a channel formed in said nozzle assembly to cause transverse oscillation of said nozzle assembly.

14. Apparatus according to claim 10 wherein said oscillating means is defined by alternating pulses of liquid delivered under sufficiently high pressure against opposite sides of said nozzle assembly to impart transverse oscillation thereto.

15. Apparatus for forming channels in relatively hard rock materials comprising:

a nozzle assembly including means for supplying water under pressure to form a series of high intensity jets discharged from said nozzle assembly, said jets formed by a series of nozzles arranged along one surface of said nozzle assembly disposed in confronting relation to the surface to be cut;

motor drive means for advancing said nozzle assembly at a predetermined rate of speed in proximity to the surface of the material to be cut; and selectably adjustable oscillating means for automatically oscillating said nozzle assembly at a selected frequency in a direction transversely of its direction of travel along the surface of the material.

16. Apparatus according to claim 15, wherein said orifices are arranged to produce a divergent jet pattern in a direction normal to the line of cut, said oscillating means being operative to oscillate said nozzle assembly over a distance approximating one-half the width of the jet pattern formed by said orifices and at frequency in the range of 750 cycles per minute.

17. Apparatus according to claim 15 in which liquid supply means includes elongated sleeve guide means and cylindrical supports depending downwardly therefrom for suspension of said nozzle assembly a predetermined height above the surface to be cut, and alternating pulse jet delivery means extending through said sleeve guide and terminating in orifices directed at opposite sides of said nozzle assembly whereby to impart transverse oscillation of said nozzle assembly.

18. Apparatus according to claim 15 in which said nozzles are defined by externally threaded sleeve members threadedly connected into counterbores formed in said nozzle assembly, and an annular sapphire nozzle portion seated in each of said sleeve members, each nozzle portion defining an orifice concentrically located with respect to the hollow interior of each respective sleeve member.

19. The method of cutting hard rock materials comprising the steps of:

(a) directing a plurality of high intensity liquid jets by means of nozzles to impinge on an oblong area of the surface of the material to be cut; and (b) simultaneously moving said jets in a direction corresponding to a selected one of the major and minor axes of the oblong area to effect a straight channel cut while rapidly oscillating the jets along a direction corresponding to the other of said axes.

20. The method according to claim 19 wherein the amplitude of oscillation is approximately one-half the width of said oblong area along the axis of oscillation.

21. The method according to claim 20 wherein the total distance of travel for said pattern along the axis of oscillation is greater than the distance of movement of said pattern along the other axis by a factor of at least 1.5.

22. The method according to claim 20 further including the step of maintaining the nozzles at a substantially constant distance from the surface of the material to be cut.

23. The method according to claim 1 wherein the advancement of said jet along the line to be cut coupled with the oscillation of said jet transversely of the line to be cut defines a sinusoidal path of travel having a wavelength approximately 0.160 inch and an amplitude of approximately 0.375 inch on the surface of the material.

24. Apparatus according to claim 10 wherein said nozzle assembly includes a series of nozzles arranged to produce a divergent jet pattern with jets located on the outer portion of said pattern being of greater pressure than those jets on the inner portion of said pattern.

25. The method according to claim 1 wherein said high intensity jet is directed against said surface as a continuous stream of fluid.

26. Apparatus according to claim 10 wherein said high intensity jet is discharged from said nozzle as a continuous stream, said means for supplying liquid under pressure operative to form said high intensity continuous jet.

* * * * *